United States Patent [19]

Snoek et al.

[11] 4,393,891

[45] Jul. 19, 1983

[54] DEVICE FOR TEMPORARILY RINSING A WATER COCK COUNTERSUNK IN THE GROUND

[75] Inventors: Govert J. Snoek; William J. Tuil, both of Dieren, Netherlands

[73] Assignee: Ocean B.V., Dieren, Netherlands

[21] Appl. No.: 304,678

[22] Filed: Sep. 22, 1981

[30] Foreign Application Priority Data

Sep. 23, 1980 [NL] Netherlands ..... 8005300

[51] Int. Cl.[3] ..... B08B 9/02; F16K 31/122

[52] U.S. Cl. ..... 137/238; 137/299; 137/300; 137/505.13; 134/166 C; 222/148; 251/50

[58] Field of Search ..... 137/238, 240, 272, 281, 137/291, 299, 300, 302, 304, 306, 613, 624.12, 505.13, 624.14; 134/166 C; 222/148; 251/50, 52

[56] References Cited

U.S. PATENT DOCUMENTS

| | | | |
|---|---|---|---|
| 574,744 | 1/1897 | Malmquist | 137/291 |
| 1,297,001 | 3/1919 | O'Shields | 137/302 |
| 1,501,799 | 7/1924 | Neumeyer | 137/302 |
| 3,262,464 | 7/1966 | Frantz | 137/613 |
| 3,559,677 | 2/1971 | Barosko | 137/505.13 |
| 3,576,193 | 4/1971 | Rothfuss | 137/505.13 |
| 3,650,471 | 3/1972 | Sutton | 137/272 |
| 3,913,602 | 10/1975 | Yoon | 137/301 |
| 3,980,097 | 9/1976 | Ellis | 137/283 |

FOREIGN PATENT DOCUMENTS 2014669 8/1979 United Kingdom .

*Primary Examiner*—George L. Walton

*Attorney, Agent, or Firm*—Birch, Stewart, Kolasch & Birch

[57] ABSTRACT

The present invention relates to a device for periodically rinsing a water cock countersunk in the ground. A drainpipe is connected between the water cock and a closing member of an extension piece. The drainpipe includes a valve body which is opened by the water pressure prevailing in the extension pipe when the water cock is initially opened. After a predetermined period of time the valve body is closed. Thus, the present invention ensures that after the water cock is opened dirt is flushed away through the drainpipe which is subsequently automatically closed after a predetermined time. After the drainpipe is closed, a valve member connected to the extension pipe can be opened and only pure water will be supplied.

8 Claims, 7 Drawing Figures

DEVICE FOR TEMPORARILY RINSING A WATER COCK COUNTERSUNK IN THE GROUND

BACKGROUND OF THE INVENTION

The invention relates to a device for temporarily rinsing a water cock countersunk in the ground and being extensible by means of an extension piece in conjunction with a closing member above the ground.

For extending a water tap countersunk in the ground by means of an extension piece with a closing member first the extension piece with the closing member is coupled with the water tap, then the tap is opened by means of a tool and subsequently the closing member is opened for the supply of water to be used. Before the closing member and the valve of the water tap are opened, the cock and the extension piece contain air instead of water. When the valve of the water tap is opened, the air-filled space is gradually filled with water and also with road dirt accumulated in the area of the valve, with insects, with chemical impurities carried along the rain water and so on. When the free space is filled with this polluted water, the condition stabilizes and the impurities have the opportunity to settle down to the lowermost point. The lowermost point i.e. the valve of the water cock now is in open communication with the transport duct of the water mains. It thus occurs that the impurities are carried along by the water streams in the transport duct, which is, of course, an extremely undesirable situation. With regard thereto a number of water companies have implemented rules for combating this pollution frequently occuring in practice. It has, for example, been required to mount an extension piece only under the supervision of a competent member of the company's staff. It is noted here that even under the supervision of a competent person human errors are not excluded so that this measure essentially does not solve the problem involved.

SUMMARY AND OBJECTS OF THE INVENTION

The invention has for its object to provide a device which fully automatically conducts away the dirt accumulated in the area of the valve without the risk of dirt getting into the water mains. To this end the invention provides a device of the type referred to in the preamble which comprises a drain pipe connectable between the water cock and the closing member of the extension piece, said pipe includes a valve body closing the drain pipe with a delay caused by the water pressure prevailing in the extension piece when the water cock is opened. Thus by means of the device according to the invention it is ensured that after the water cock is opened the dirt is flushed away through the drain pipe, which automatically closes after a preset time, for example, 10 seconds. When the drain pipe is closed, the closing member of the extension piece can be opened and only pure water will be supplied.

Preferably the valve body is provided with a closing body fastened to a piston movable in a cylinder and being loaded in the direction in which the valve member is opened by a spring whilst the cylinder space for the closure of the valve member is in open communication through a narrowed passage with the opening of the drain pipe connectable with the extension piece.

BRIEF DESCRIPTION OF THE DRAWINGS

The invention will be described more fully with reference to a drawing in which.

DETAILED DESCRIPTION OF THE INVENTION

Figure 1:
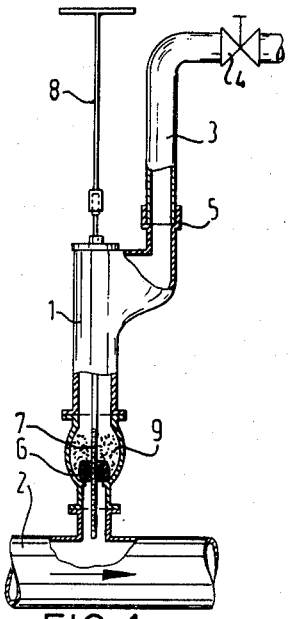
FIGS. 1, 2 and 3 show a water cock to which an extension piece is connected by known techniques in three consecutive phases.

FIG. 1 shows a water cock countersunk in the ground, designated as a whole by reference numeral 1 and communicating with the transport pipe 2. In the situation illustrated in FIG. 1 and extension piece 3 including a closing member 4 is placed on the bayonet joint 5. The water cock 1 is still closed as is shown by the lowermost position of the valve 6, which can be opened by means of the rotatable screw spindle 7 with the aid of a wrench 8. For this purpose the screw spindle 7 extends through a sleeve rigidly coupled with the valve and having inner screwthread, whilst the valve is guarded against rotation.

The situation shown in FIG. 1 is the first phase in which the extension pipe piece 3 with closed closing member 4 is coupled with the cock 1, whilst the wrench 8 has not yet been turned for opening the valve 6.

Above the valve 6 an amount of dirt, chemical impurities, dead insects, sand or the like has accumulated. These undesirable substances are designated by reference numeral 9.

In FIGS. 1 to 6 the arrow in the transport pipe 2 indicates the direction of flow of the water under pressure.

Figure 2:
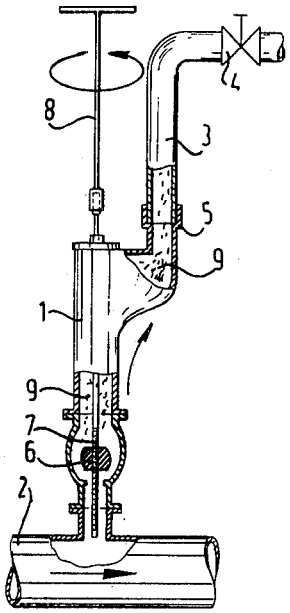

FIG. 2 shows a next phase in which the valve 6 is opened by turning the wrench 8 as indicated by the curved arrow at the wrench 8. The space between the valve 6 and the closing member 4, initially filled with air, is now filled with pressurized water together with a large part of the amount of dirt, impurities and the like accumulated above the valve 6. The direction of flow is indicated by a slightly curved arrow midway positional along the water cock. It is obvious that the dirt 9 can then spread in the space between the valve 6 and the closed closing member 4. The amount of air initially contained therein cannot escape and stays in a small space in front of the closing member 4. The air there assumes the pressure of the water.

Figure 3:
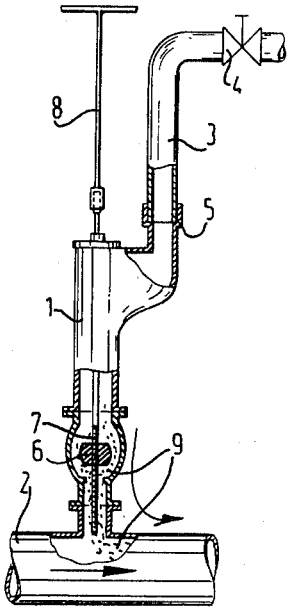

FIG. 3 shows the critical phase, i.e. that in which the situation is such that the water contained in the cock and the extension piece is in a rest position and the impurities contained therein have the opportunity of gradually settling down so that they can be carried along through the transport pipe 2 as is indicated by a curved arrow between the cock 1 and the transport pipe 2.

Figure 4:
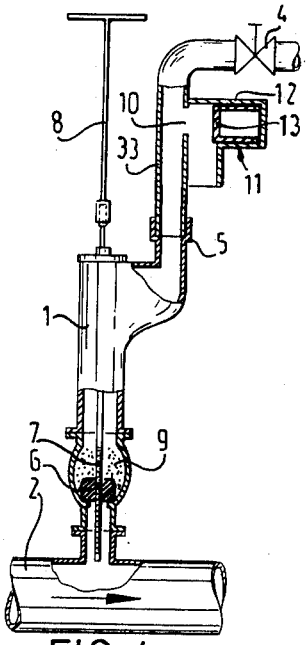
FIGS. 4, 5 and 6 show a water cock to which is connected an extension piece with a device embodying the invention in the phases corresponding with those of FIGS. 1,2 and 3 respectively

FIG. 4 shows a situation corresponding with that of FIG. 1. However in this case the extension piece 33 has an opening 10 in the wall which communicates with a drain pipe device 11 embodying the invention.

Figure 5:
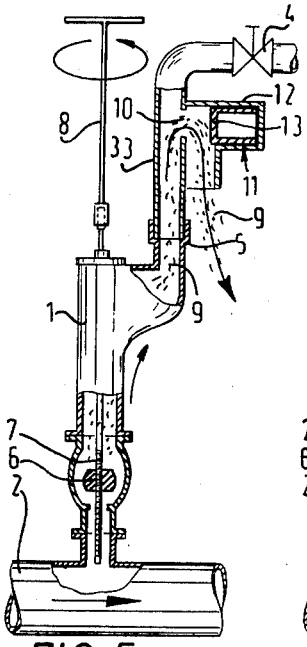
Figure 6:
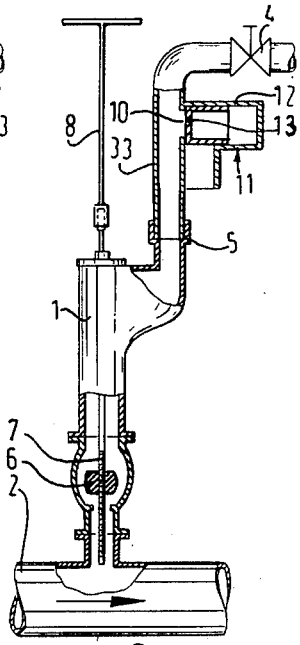

Hereinafter with reference to FIG. 7 the construction of the drain pipe device 11 embodying the invention will be described in further detail. With reference to FIGS. 4 to 6 the preparation of the extension pipe piece for operation will be described. In the simple embodiment of the drain pipe device 11 shown comprises a housing 12, a piston 13 movable inside the same and forming a valve 10 with the interior of the extension piece 33.

In the situation shown FIG. 4 the valve 6 is closed and the same impurities 9 are accumulated above the valve 6. The extension piece 3 is connected; the closing member 4 is still closed. Since the piston 13 is in its extreme right-hand position, the interior of the extension pipe piece 33 directly communicates through the opening 10 and the drain pipe 14 with the atmosphere.

FIG. 5 shows the situation corresponding with that of FIG. 2, in which the valve 6 is opened by means of the wrench 8. The closing member 4 is still closed. From FIG. 5 it will be apparent that the pressurized water emanating from the transport pipe 2 flushes the impurities 9 through the extension pipe piece 33, the opening 10 and the drain pipe. The water leaving the drain pipe carries the impurities therealong. The cock is thoroughly rinsed.

By steps to be described hereinafter with reference to FIG. 7 the piston 13 moves gradually to the left under the action of the water pressure so that the drain pipe 20 is gradually closed further.

FIG. 6 shows the situation in which the drain pipe is completely closed by the piston 13. It will be obvious that the impurities are then flushed away and pure water can be obtained by opening the closing member 4.

Figure 7:
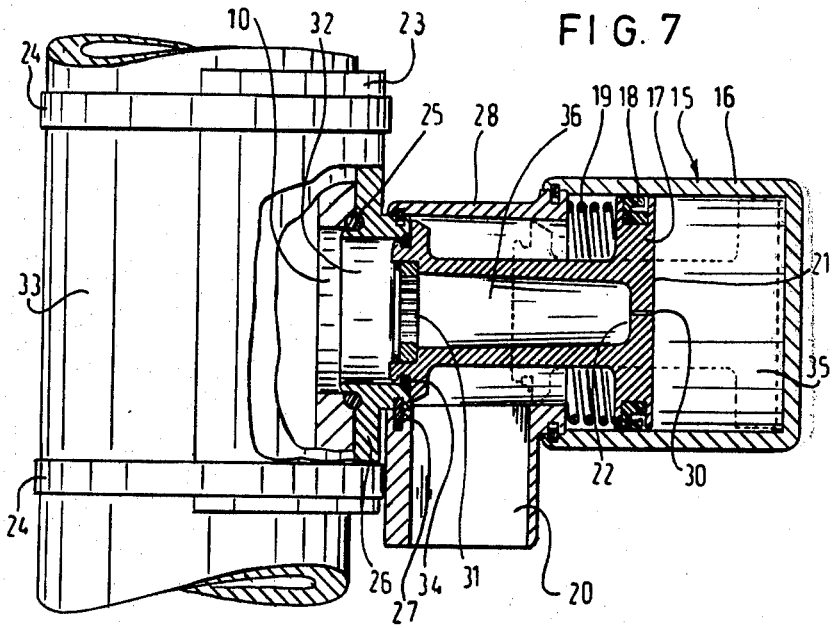
FIG. 7 shows a preferred embodiment of the device in accordance with the invention.

FIG. 7 shows an embodiment of a device 15 according to the invention fastened to the extension piece 33 with the opening 10 in its wall. This device comprises a cylinder 16, in which a piston 17 is displaceable positioned. The seal between the cylinder sheath and the piston is obtained by means of a ring 18 having a substantially U-shaped profile. The piston is urged into the right-hand position indicated by broken lines by the effect of the compression spring 19. In this situation the drain pipe 20 forming part of the device 15 is open and is in open communication through the opening 10 with the interior of the extension piece 33. The piston has a comparatively narrow bore 30 through which the right-hand piston surface 21, which also bounds the active cylinder space 35 communicates with the left-hand piston surface 22 also bounding the space 36, which directly communicates through the opening 10 with the interior of the extension piece 33. Owing to the difference between the piston surface 21 and the piston surface 22 the right-hand piston surface is exposed to a heavier force than the left-hand piston surface 22, the water pressure on both surfaces being the same so that a force counteracting the spring 19 is exerted on the piston 17 to the left. Owing to these forces the piston 17 is gradually moved to the left, when the valve 6 is opened, until the access to the drain pipe i.e. the opening 32 joining the opening 10 is completely closed so that the drain opening is no longer communicating with the interior of the extension pipe piece 33. A ring 34 ensures a satisfactory seal.

Under the action of the water pressure the closed state is maintained in the extension pipe piece until the valve 6 is again closed and the water pressure in the cock 1 disappears. In order to avoid clogging of the bore 30 due to impurities a sieve 31 is provided on the remote (left-hand) side of the piston 17.

The device 15 is connected by means of a flange 23 having a curvature matching the shape of the main pipe by braces 24 to the main pipe. The watertight seal is ensured by a rubber ring 25.

From FIG. 7 it will be seen that the flange 23 forms part of a connecting part 26 carrying by means of a circlip 27 a drain pipe part 28, which in turn carries the cylinder 26 by means of a circlip 29.

The passage of the bore 30 is one of the factors determining the speed by which at a given water main pressure the piston 17 moves into its closed position and hence the time elapsing until the end of the flushing phase. The time during which the piston is displaced from its opened position to its closed position is shorter, the higher is the pressure of the mains. In this way it is ensured that more or less independently of the water main pressure the amount of flushing water required for removing the dirt is always the same.

The invention is not limited to the embodiment described above. The passage of the bore 30, for example, may be variable so that for different applications different closing times are obtained. Moreover, the shape of the piston 17 may differ from that shown without detracting from the satisfactory operation.

It will furthermore be obvious that the closing member 4 need not be integrated in the extension pipe piece 3.

Finally it should be noted that the conduit with the narrowed passage need not have the shape of the bore 30, and that a separate conduit may connect the opening 32 with the active cylinder space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A drain valve for use with a water cock countersunk into the ground surface and including an extension pipe piece with a closing member being disposed above the ground surface, said water cock being in fluid communication with said extension pipe piece and said closing member comprising:

a drain pipe device operatively connected between the water cock and the closing member positioned in the extension pipe piece;

a valve body slidable disposed adjacent to said drain pipe device to selectively permit the fluid communication between said extension pipe piece and said drain pipe device;

biasing means for normally biasing said valve body into an open position for normally permitting the fluid communication between said extension pipe piece and said drain pipe device during initial opening of said water cock for permitting rinsing of impurities from the water cock prior to the opening of said closure member; and delay closing means actuated by fluid pressure within said extension pipe piece for closing said valve body to prevent communication between said extension pipe piece and said drain pipe device after the expiration of a predetermined time period.

2. A drain valve according to claim 1, wherein said drain pipe device is cylindrical and said valve body is slidably mounted within a cylindrical member adjacent to said drain pipe device to selectively permit communication between said extension pipe piece and said drain pipe device.

3. A drain valve according to claim 1, wherein said valve body is an extended cylindrical member having a piston head and a hollow central portion.

4. A drain valve according to claim 3, wherein fluid pressure within said extension pipe piece is in communication with said hollow central portion of said valve body and flows through said passageway to apply pressure to said piston head to close said valve body against the force of said biasing means after the expiration of a predetermined time period.

5. A drain valve according to claim 3, wherein said hollow central portion is in communication with said extension pipe piece and a passageway provides communication between said hollow central portion and said piston head.

6. A drain valve according to claim 5, and further including a sieve positioned within said hollow central portion for preventing impurities from clogging said passageway.

7. A drain valve according to claim 5, wherein said passageway is a restricted passage.

8. A drain valve according to claim 1, wherein said biasing means is a spring for holding said valve body in an open position.

* * * * *